United States Patent [19]

Ouelette et al.

[11] 4,059,326

[45] Nov. 22, 1977

[54] DRY-TYPE INSTRUMENT TRANSFORMER WITH POTENTIAL TAP AND CONNECTOR THEREFOR

[75] Inventors: Ronald J. Ouelette, Derry, N.H.; Robert S. Canney, Berwick, Maine; Ralph B. Stetson, Exeter, N.H.

[73] Assignee: General Electric Company, Somersworth, N.H.

[21] Appl. No.: 662,782

[22] Filed: Mar. 1, 1976

Related U.S. Application Data

[62] Division of Ser. No. 458,704, April 8, 1974, Pat. No. 3,959,760.

[51] Int. Cl.[2] ..... H01R 3/00

[52] U.S. Cl. ..... 339/113 R; 200/144 C; 339/143 R

[58] Field of Search ..... 339/113, 111, 143 R; 200/144 C, 147 R, 149 A

[56] References Cited

U.S. PATENT DOCUMENTS

| | | | |
|---|---|---|---|
| 2,163,412 | 6/1939 | Schneider | 339/143 R |
| 3,377,487 | 4/1968 | McNulty | 307/17 |
| 3,463,932 | 8/1969 | Weinfurt | 307/17 |
| 3,569,915 | 3/1971 | Sorensen et al. | 339/143 R |
| 3,868,616 | 2/1975 | Yonkers | 337/201 |

*Primary Examiner*—Roy Lake
*Assistant Examiner*—DeWalden W. Jones
*Attorney, Agent, or Firm*—Robert E. Brunson; Philip L. Schlamp

[57] ABSTRACT

A dry-type instrument transformer having a potential tap in the form of a well molded into the body of the transformer. A female conductor terminal is provided inside the well connected to the high voltage winding of the transformer. A connector in the form of an elbow module fits within the well and has a male conductor member which mates with the female member. A ground coating is provided on the exterior surface of the transformer and is in conductive relation to a ground coating on the elbow module. A metering system having a potential transformer and a current transformer each with a potential tap and connected together by a pair of interconnected elbow modules.

3 Claims, 7 Drawing Figures

14
10
22
20
24
18
12
3
32
3
36
16
34

32
26
12
24
10
34
22
20
30
28
18
14
16

66
62
50
54
52
42
64
40
44
48
46
38
68
70
60

DRY-TYPE INSTRUMENT TRANSFORMER WITH POTENTIAL TAP AND CONNECTOR THEREFOR

This is a division of application Ser. No. 458,707, filed Apr. 8, 1974, now U.S. Pat. No. 3,959,760.

BACKGROUND OF THE INVENTION

This invention relates to instrument transformers and more particularly to dry-type instrument transformers with potential taps and to connector modules mating with such potential taps.

In the metering and control art it is well known to use instrument transformers such as potential transformers and current transformers to isolate high voltage circuits and provide a means of transforming voltage or currents to values that are convenient to measure or use in control circuits. In the metering art, it is often desirable to interconnect current transformers and potential transformers to obtain desired values for metering. In such interconnecting, it is necessary to provide a potential connection between the high voltage terminal of the current transformer and the high voltage terminal of the potential transformer. With present day dry-type instrument transformers the connection between such high voltage terminals is often made by means of clamp type connections which must be tapped or otherwise shielded to eliminate dangerous potentials. With the advent of dead-front connections and pad mounted equipment, it is considered desirable to provide dry-type instrument transformers with potential taps whereby such transformers may be interconnected for metering applications while still maintaining the dead-front connections. Also, for mounting in enclosed spaces, it is desirable to provide ground shields or coatings on the surfaces of the dry-type instrument transformers to eliminate any high voltage gradient on such surfaces. As will be apparent, such ground shields will reduce the danger of electrical shock and allow smaller metering enclosures.

It is therefore a primary object of this invention to provide potential taps for dry-type instrument transformers.

A further object of this invention is to provide potential taps for dry-type instrument transformers which are recessed in the insulation body of such instrument transformers.

A still further object of this invention is to provide potential taps recessed into the insulation body of dry-type instrument transformers and a connector module which will make dead-front electrical connection with such potential taps.

A still further object of this invention is to provide elbow-type connector modules having electrical conductors for mating with recessed potential taps of dry-type instrument transformers.

A still further object of this invention is to provide dry-type current and potential transformers, each having recessed potential taps and a pair of elbow connector modules for interconnecting the transformers for metering application.

SUMMARY OF THE INVENTION

Briefly, in one form this invention comprises dry-type instrument transformers having a well in the insulation body of such transformers. The well provides a potential tap and recessed within the well is an electrical terminal which is connected to the high voltage winding of the instrument transformer. A connector module is provided for insertion into the well and making electrical connection to the recessed terminal within such well. A ground coating is provided on the surface of the instrument transformer as well as on the connector module and such coatings are electrically connected when the connector module is in place in the well.

According to another feature of this invention, a dry-type current and potential transformer each having recessed potential taps are interconnected for metering applications by a pair of connector modules which are electrically connected together and electrically connected to the potential taps.

The invention which is sought to be protected will be particularly pointed out and distinctly claimed in the claims appended hereto. However, it is believed that this invention and the manner in which its objects and advantages are obtained as well as other objects and advantages thereof will be more fully understood by reference to the following detailed description of a preferred embodiment, particularly when considered with the accompanying drawings.

DESCRIPTION OF PREFERRED EMBODIMENT

Figure 1:
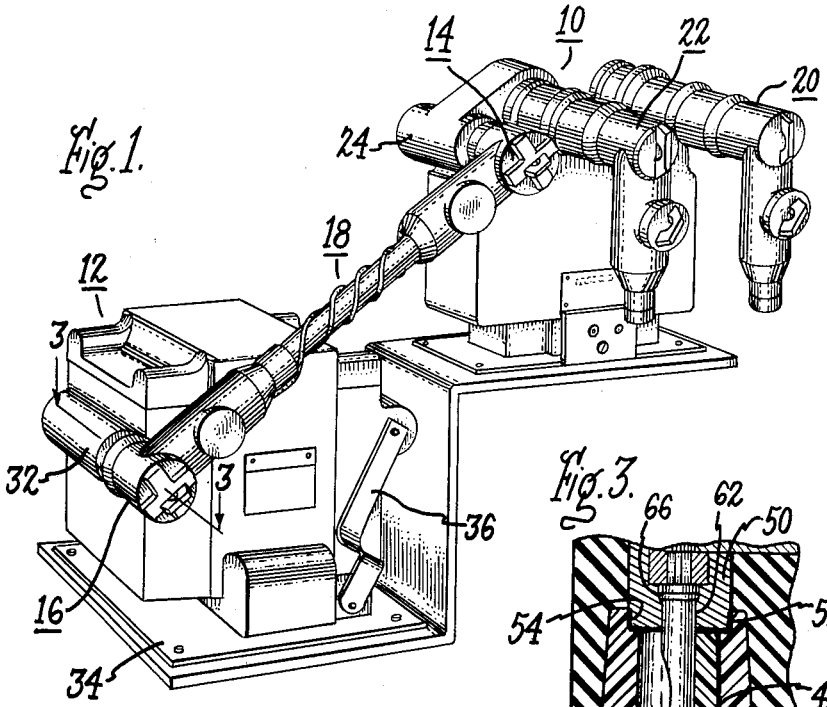
FIG. 1 is a perspective view of a current transformer and a potential transformer interconnected for a metering application according to the preferred form of this invention.
Figure 2:
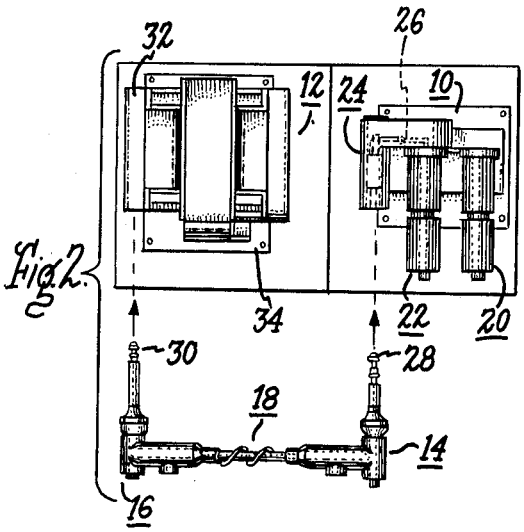
FIG. 2 is a top view on a reduced scale of the current transformer and potential transformer of FIG. 1 showing the connector modules in an exploded view from the transformers.

This invention discloses dry-type instrument transformers suitable for interconnection in metering applications with dead-front type connections. In referring to the drawings, like numerals will be used to indicate like parts throughout the various views. Considering first FIGS. 1 and 2, a dry-type current transformer 10 and a dry-type potential transformer 12 are shown interconnected by connector modules 14 and 16, respectively, in a metering application. The cable 18 interconnects modules 14 and 16 in the manner shown. The current transformer 10 is shown as provided with standard elbow connector modules 20 and 22 to provide primary energization of current transformer 10. Such elbow connector modules are shown for example, in U.S. Pat. No. 3,763,461. A potential tap 24 is provided in current transformer 10 connected internally to the primary or high voltage winding or terminal (not shown), which is energized by the elbow 22, as is indicated by dotted lines 26 in FIG. 2. As will be understood, male connector 28 of connector module 14 electrically connected to the conductor of potential tap 24 of the current transformer 10 while the male connector 30 of connector module 16 electrically connects to the conductor of potential tap 32 of potential transformer 12 as will be more fully discussed hereafter. The conductor of potential tap 32 is connected to the high voltage winding (not shown) of potential transformer 12. When used for metering line to ground, the grounded neutral terminal of potential transformer 12 is connected to the baseplate 34 by ground strap 36, as shown. Obviously, a second potential tap can be provided in potential transformer 12 when it is desired to meter line to line.

Figure 6:
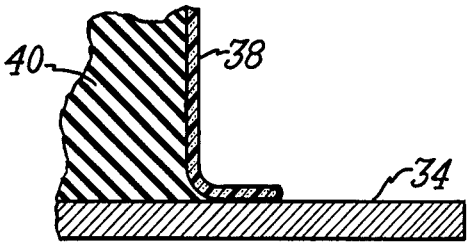
FIG. 6 is a partial sectional view showing the ground shield and its grounding according to the preferred embodiment of this invention.

In the preferred embodiment, the surfaces of both the current transformer 10 and the potential transformer 12 are provided with a low resistance conductive ground shield. Preferably, a low resistance conductive elastomer such as EPDM is used. The elastomer is sprayed on the surfaces of the transformers and is then cured to form a strong bond with such surfaces and also to develop its maximum physical properties. In FIG. 6 the conductive ground shield or coating is indicated as 38, while the transformer insulation is shown as 40. The shield 38 is effectively grounded by bonding to a large area of the baseplate, such as baseplate 34, as shown in FIG. 6.

Figure 3:
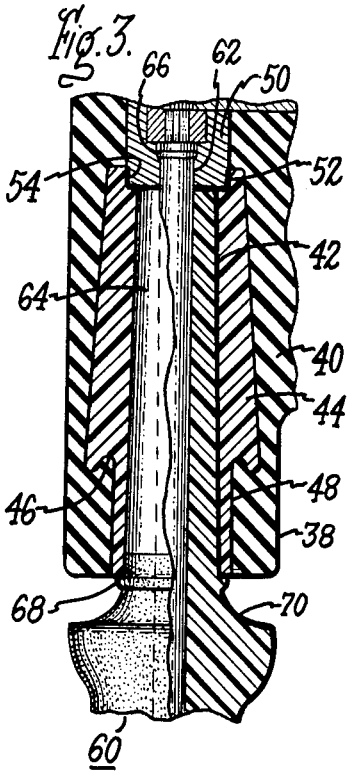
FIG. 3 is a partial sectional view on an enlarged scale taken along the line 3—3 of FIG. 1 showing the preferred embodiment of the potential tap and a portion of the connection module of this invention.
Figure 4:
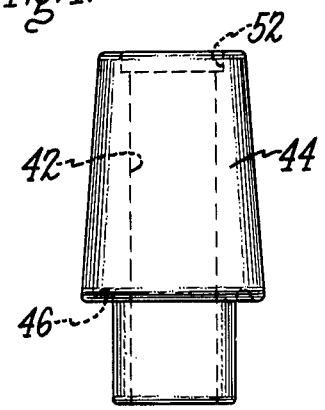
FIG. 4 is a plan view of a sleeve member used in the potential tap according to the preferred embodiment of this invention.

The preferred form of potential tap is best seen in FIG. 3 of the drawings. While the description will be related to potential transformer 12, it will be understood that the potential tap 24 of current transformer 10 is of like construction. As shown in FIG. 3, a tapered well 42 is formed in insulation 40, which forms the body of potential transformer 12. In the preferred embodiment shown, the well 42 is formed by an epoxy sleeve 44 which is pre-molded (see FIG. 4) and then molded into the insulation 40 of potential transformer 12. The epoxy sleeve 44 is preferred since it provides dimensional stability to the well 42. Obviously, the well 42 could be molded directly in the insulation 40 if desired. However, as above noted, the epoxy sleeve 44 is preferred. The epoxy sleeve 44 is preferably molded with a groove 46 which aids in locking the sleeve 44 in the insulation 40 as is clearly apparent from FIG. 3. When sleeve 44 is used, the exterior surface down to groove 46 is coated with a conductive coating 48 to reduce electrical stress between insulation 40 and sleeve 44. A female terminal 50 is provided in potential transformer 12 at the base of the well 42. As will be understood, the terminal 50 is connected to the high voltage winding (not shown) of the potential transformer 12. A depression 52 is formed in the inner end of sleeve 44, the depression 52 receiving the end of female terminal 50, as shown. In the preferred form, a conductive coating 54 is applied to such depression to help reduce the voltage stress in this area.

Figure 5:
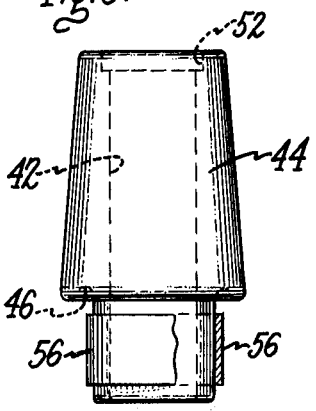
FIG. 5 is a view similar to FIG. 4 showing the use of a reinforcement according to this invention.

In a modified form of sleeve 44, a metal reinforcing member 56 is provided on the outer surface as shown in FIG. 5. Reinforcing member 56 is in the form of a metal ring fitting over the outer surface of sleeve 44. The ring 56 may be of any desired metal, although brass is presently preferred. The ring 56 prevents cracking of the end of sleeve 44 when the transformer is subjected to rough handling.

Figure 7:
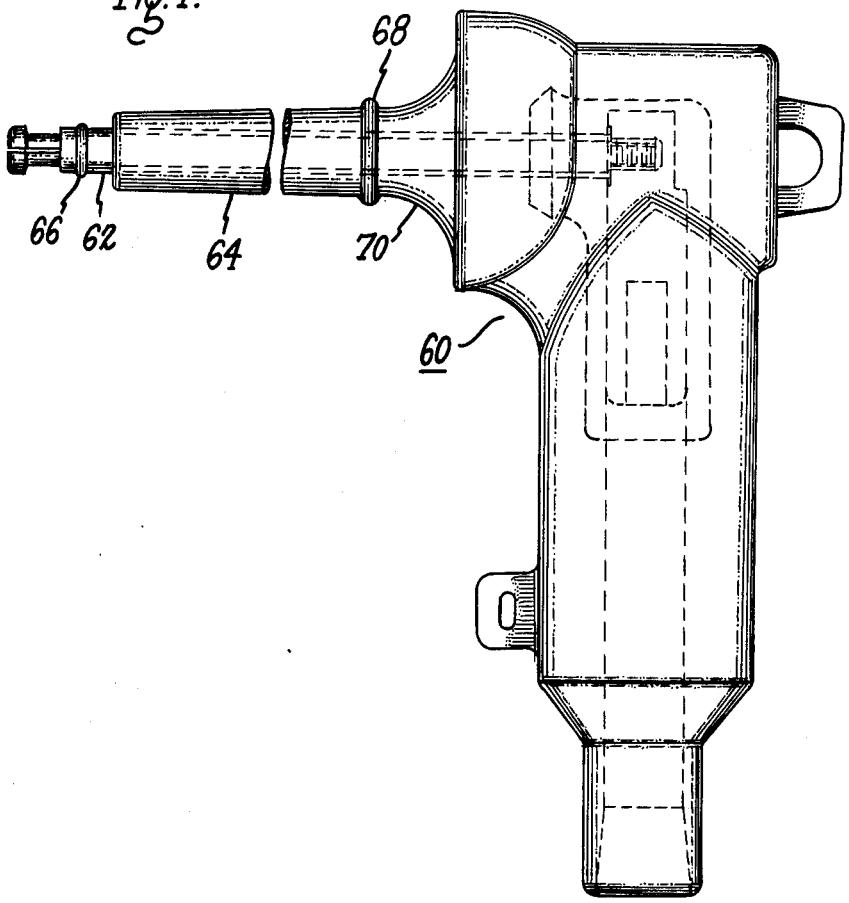
FIG. 7 is a plan view of the preferred form of connector module according to this invention.

A special elbow connector module 60 is used with the potential tap as can be seen from FIG. 3. The elbow connector module 60 is best shown in FIG. 7 of the drawings. The elbow connector module 60 is molded from an elastomeric material such as EPDM. It is provided with a male conductor 62 which makes electrical contact with the female terminal 50 as is shown in FIG. 3. In the preferred form, the elbow module 60 is provided with a tapered insulated male member 64 which closely surrounds the male conductor 62. As is apparent from FIG. 3, the insulating member 64 fits tightly in well 42 providing a substantially watertight seal. Conductor 62 is provided with a locking ring 66 which locks into the female terminal 50. Also provided is an indicating member 68 formed on the insulating member 64 which will fit against the outer edge of well 42 when the conductor 62 is properly seated in female terminal 50. As is shown, a ground coat 70 covers the outer surface of elbow module 60 and extends slightly below the indicating member 68. This will ensure a good conducting contact with the ground coat 38 on the transformer. The elbow 60 also includes a conducting insert, a cable entrance, a pulling eye and the like. However, these elements are standard with elbow modules of the prior art (see for example, U.S. Pat. No. 3,539,972) and will not be further described.

From the above, it will be apparent that by means of this invention there is provided dry-type instrument transformers which may be readily interconnected in metering applications to provide dead-front type connections. While there has been shown and described the present preferred embodiment of the invention, it will be apparent to those skilled in the art that various modifications may be made without departing from the spirit and scope of the invention, especially as defined in the appended claims.

What is claimed as new and which it is desired to secure by Letters Patent of the United States is:

1. An elbow module for use with an instrument transformer having a potential tap recess mounted in a well of the instrument transformer to provide a dead-front electrical connection which eliminates dangerous potentials at the point of connection, said elbow comprising:

a. a length of conductor for connection to the potential tap; and b. an elongated insulating male member for insertion into the well of said instrument transformer, said insulating male member surrounding the length of said conductor except for a portion of said conductor which extends beyond one end of said insulating male member whereby said conductor is insulated from said transformer except at the point of connection of said conductor to the potential tap when said insulating male member is inserted into the well.

2. An elbow as claimed in claim 1, in which a ground coat is provided on said elbow and extends along a minor portion of the elongated insulating male member at the entrance end of the well for making a connection to a ground coat on the instrument transformer.

3. An elbow module as claimed in claim 1 and including an indicating member on the upper end of said elongated insulating male member to engage the surface of the instrument transformer at the entrance end of the well when said conductor of said elbow is fully seated in the potential tap of the transformer.

* * * * *